US010550686B2

(12) United States Patent
Van Steenwyk et al.

(10) Patent No.: US 10,550,686 B2
(45) **Date of Patent: *Feb. 4, 2020**

(54) TUMBLE GYRO SURVEYOR

(71) Applicant: Scientific Drilling International, Inc., Houston, TX (US)

(72) Inventors: Brett Van Steenwyk, Paso Robles, CA (US); Tim Whitacre, Paso Robles, CA (US)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 157 days.

This patent is subject to a terminal disclaimer.

(21) Appl. No.: 15/872,830

(22) Filed: Jan. 16, 2018

(65) Prior Publication Data

US 2018/0156027 A1 Jun. 7, 2018

Related U.S. Application Data

(63) Continuation of application No. 14/946,394, filed on Nov. 19, 2015, now Pat. No. 9,903,194.

(60) Provisional application No. 62/081,936, filed on Nov. 19, 2014.

(51) Int. Cl.
*E21B 47/022* (2012.01)

(52) U.S. Cl.
CPC ..... *E21B 47/022* (2013.01)

(58) Field of Classification Search
CPC ..... E21B 47/022
USPC ..... 33/313, 318
See application file for complete search history.

(56) References Cited

U.S. PATENT DOCUMENTS

| | | | | |
|---|---|---|---|---|
| 4,197,654 | A * | 4/1980 | Van Steenwyk | E21B 47/022 33/304 |
| 4,265,028 | A * | 5/1981 | Van Steenwyk | E21B 47/022 33/304 |
| 4,297,790 | A | 11/1981 | Van Steenwyk et al. | |
| 4,433,491 | A * | 2/1984 | Ott | E21B 47/022 33/302 |
| 4,461,088 | A * | 7/1984 | Van Steenwyk | E21B 47/022 33/304 |
| 4,559,713 | A * | 12/1985 | Ott | E21B 47/022 33/302 |
| 4,756,088 | A * | 7/1988 | Russell | E21B 47/022 33/312 |

(Continued)

FOREIGN PATENT DOCUMENTS

| | | |
|---|---|---|
| RU | 2111454 C1 | 5/1998 |
| RU | 34009 U1 | 11/2003 |
| SU | 166289 A1 | 11/1964 |

OTHER PUBLICATIONS

Office Action issued in Russian patent application No. 2017117250/03 dated Apr. 12, 2019 and translation thereon (17 pages).

*Primary Examiner* — George B Bennett
(74) *Attorney, Agent, or Firm* — Adolph Locklar

(57) ABSTRACT

A gimbal sensor platform positionable in a tool body includes an inner gimbal and an outer gimbal. The inner gimbal is rotatably coupled to the outer gimbal, and the outer gimbal is rotatably coupled to the tool body. The inner and outer gimbals may each be rotated by an angular positioning device. A gyro or other sensor may be coupled to the inner gimbal. The gyro or other sensor may be reoriented by rotating the outer gimbal, the inner gimbal, or both.

28 Claims, 3 Drawing Sheets

(56) References Cited

U.S. PATENT DOCUMENTS

| | | | | |
|---|---|---|---|---|
| 6,347,282 | B2 * | 2/2002 | Estes | G01C 19/38 702/6 |
| 9,903,194 | B2 * | 2/2018 | Van Steenwyk | E21B 47/024 |
| 2005/0240350 | A1 * | 10/2005 | Engebretson | G01V 7/16 702/6 |
| 2009/0119937 | A1 * | 5/2009 | Watson | E21B 47/022 33/313 |
| 2010/0089572 | A1 * | 4/2010 | Chang | E21B 47/024 166/255.2 |

* cited by examiner

TUMBLE GYRO SURVEYOR

CROSS-REFERENCE TO RELATED APPLICATIONS

This application is a continuation of U.S. patent application Ser. No. 14/946,394, filed Nov. 19, 2015, which is itself a nonprovisional application which claims priority from U.S. provisional application No. 62/081,936, filed Nov. 19, 2014. The entirety of each is hereby incorporated by reference.

TECHNICAL FIELD/FIELD OF THE DISCLOSURE

The present disclosure relates to downhole survey tools.

BACKGROUND OF THE DISCLOSURE

Knowledge of wellbore placement and surveying is useful for the development of subsurface oil & gas deposits. Accurate knowledge of the position of a wellbore at a measured depth, including inclination and azimuth, may be used to attain the geometric target location of, for example, an oil bearing formation of interest. Additionally, directional borehole drilling typically relies on one or more directional devices such as bent subs and rotary steering systems to direct the course of the wellbore. The angle between the reference direction of the directional device and an external reference direction is referred to as the toolface angle, and determines the direction of deviation of the wellbore. Directional drilling proceeds through comparing the placement of the borehole with the desired path, and selecting a toolface angle and other drilling parameters to advance the borehole and correct it towards the planned path. Measurement of toolface thus may be a component for borehole steering and placement.

The measurement of inclination and azimuth of the wellbore may be used in surveying operations. Inclination is the angle between the longitudinal axis of a wellbore or a drill string or other downhole tool positioned in a wellbore and the gravity vector, and azimuth is the angle between a horizontal projection of the longitudinal axis and north, whether measured by a magnetometer (magnetic north) or by a gyro (true north).

One method of determining the orientation and position of a downhole tool with respect to the Earth spin vector is to take a gyro survey, referred to herein as a gyrocompass, to determine a gyro toolface, inclination, and azimuth. The gyrocompass utilizes one or more gyroscopic sensors, referred to herein as gyros to detect the Earth's rotation and determine the direction to true north from the downhole tool, the reference direction for a gyro toolface and azimuth. However, at high inclination, i.e. where the downhole tool is nearly horizontal with respect to gravity, a single-axis gyro substantially orthogonal to the downhole tool may be unable to determine true north to sufficient accuracy. Additionally, errors in gyro readings caused by, for example and without limitation, bias errors or mass unbalance, may be undetected and induce error in the determination of true north.

The determination of orientation, position, inclination, and azimuth of the downhole tool may include determining a gravity toolface or magnetic toolface by using one or more accelerometers or magnetometers respectively. Accelerometers may be used to detect the local gravity field, typically dominated by the Earth's gravity, to determine the direction to the center of the Earth. This direction may be used as the reference direction for a gravity toolface. Magnetometers may similarly be used to detect the local magnetic field, typically dominated by the Earth's magnetic field, to determine the direction to magnetic north. This direction may be used as the reference direction for a magnetic toolface. However, errors in the sensor readings, such as offset or drift, may be undetected and induce error in the determination of toolface.

Typically, gravity toolface is utilized except where the inclination is very low, such as, for example and without limitation, 5° or less. In low inclinations, cross-axial accelerometers may measure only a small gravity signal. At low inclinations, gyro or magnetic toolface is traditionally utilized for orienting toward the target drilling direction due to the large cross-axial signal of the Earth's spin vector or magnetic field.

SUMMARY

The present disclosure provides for a gimbal sensor platform. The gimbal sensor platform may be positionable in a tool body having a longitudinal axis. The gimbal sensor platform may include an outer gimbal. The outer gimbal may be rotatably coupled to the tool body. The gimbal sensor platform may include an outer angular positioning device coupled to the outer gimbal to rotate the outer gimbal relative to the tool body about an outer gimbal axis of rotation. The gimbal sensor platform may include an inner gimbal, the inner gimbal rotatably coupled to the outer gimbal. The gimbal sensor platform may include an inner angular positioning device coupled to the inner gimbal to rotate the inner gimbal relative to the outer gimbal about an inner gimbal axis of rotation. The gimbal sensor platform may include a gyro coupled to the inner gimbal.

The present disclosure also provides for a method. The method may include providing a gimbal sensor platform positioned in a tool body. The gimbal sensor platform may include an outer gimbal. The outer gimbal may be rotatably coupled to the tool body. The gimbal sensor platform may include an outer angular positioning device coupled to the outer gimbal to rotate the outer gimbal relative to the tool body about an outer gimbal axis of rotation. The gimbal sensor platform may include an inner gimbal, the inner gimbal rotatably coupled to the outer gimbal. The gimbal sensor platform may include an inner angular positioning device coupled to the inner gimbal to rotate the inner gimbal relative to the outer gimbal about an inner gimbal axis of rotation. The gimbal sensor platform may include a gyro coupled to the inner gimbal. The method may include taking a first measurement with the gyro with the outer gimbal in a first position relative to the tool body and the inner gimbal in a first position relative to the outer gimbal. The method may include rotating the inner gimbal to a second position relative to the outer gimbal. The method may include taking a second measurement with the gyro. The method may include rotating the outer gimbal to a second position relative to the tool body. The method may include taking a third measurement with the gyro.

The present disclosure also provides for a method. The method may include providing a gimbal sensor platform positioned in a tool body. The gimbal sensor platform may include an outer gimbal. The outer gimbal may be rotatably coupled to the tool body. The gimbal sensor platform may include an outer angular positioning device coupled to the outer gimbal to rotate the outer gimbal relative to the tool body about an outer gimbal axis of rotation. The gimbal sensor platform may include an inner gimbal, the inner gimbal rotatably coupled to the outer gimbal. The gimbal sensor platform may include an inner angular positioning device coupled to the inner gimbal to rotate the inner gimbal relative to the outer gimbal about an inner gimbal axis of rotation. The inner gimbal axis of rotation may be substantially orthogonal to the outer gimbal axis of rotation. The gimbal sensor platform may include an inner limit stop positioned to constrain the rotation of the inner gimbal such that the inner gimbal contacts the limit stop when rotated to a first cant angle relative to the outer gimbal axis of rotation and when rotated to a second cant angle relative to the outer gimbal axis of rotation. The gimbal sensor platform may include a gyro coupled to the inner gimbal. The method may include taking a first measurement with the gyro with the outer gimbal in a first position relative to the tool body and the inner gimbal at the first cant angle. The method may include rotating the inner gimbal to the second cant angle. The method may include taking a second measurement with the gyro. The method may include rotating the outer gimbal to a second position relative to the tool body. The method may include taking a third measurement with the gyro.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
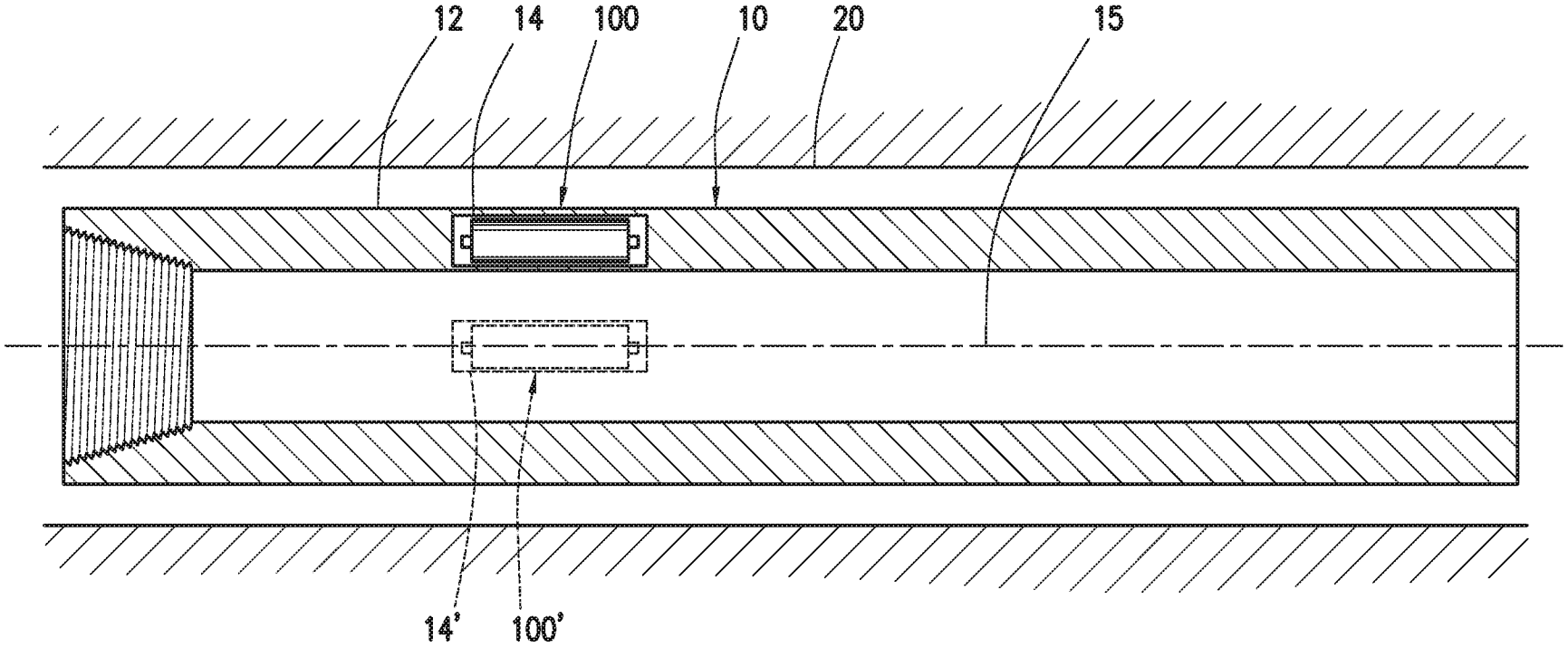
FIG. 1 depicts a cross section of a downhole tool consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts downhole survey tool 10 positioned in wellbore 20. Downhole survey tool 10 may be a part of a drill string, tool string, or any other tool positionable in a wellbore. In some embodiments, downhole survey tool 10 may be part of a directional drilling string. In some embodiments, downhole survey tool 10 may be part of a measurement while drilling (MWD) system. In some embodiments, downhole survey tool 10 may be part of a wireline conveyed measurement system. In some embodiments, downhole survey tool 10 may be a tool separate from other downhole tools or drill strings. Downhole survey tool 10 may include tool body 12. Tool body 12 may include sensor housing 14. Sensor housing 14 may be a space formed in tool body 12. Gimbal sensor platform 100 may be positioned within sensor housing 14. Although depicted as positioned in a tubular downhole survey tool 10, one having ordinary skill in the art with the benefit of this disclosure will understand that gimbal sensor platform 100 may be positionable in any downhole tool or other structure without deviating from the scope of this disclosure. For example and without limitation, downhole survey tool 10' and sensor housing 14', as depicted in FIG. 1, may be positioned separately from and within tool body 12. For the purposes of this disclosure, longitudinal axis 15 of downhole survey tool 10 is defined as extending in a direction substantially parallel to wellbore 20 at the position of downhole survey tool 10.

Figure 2:
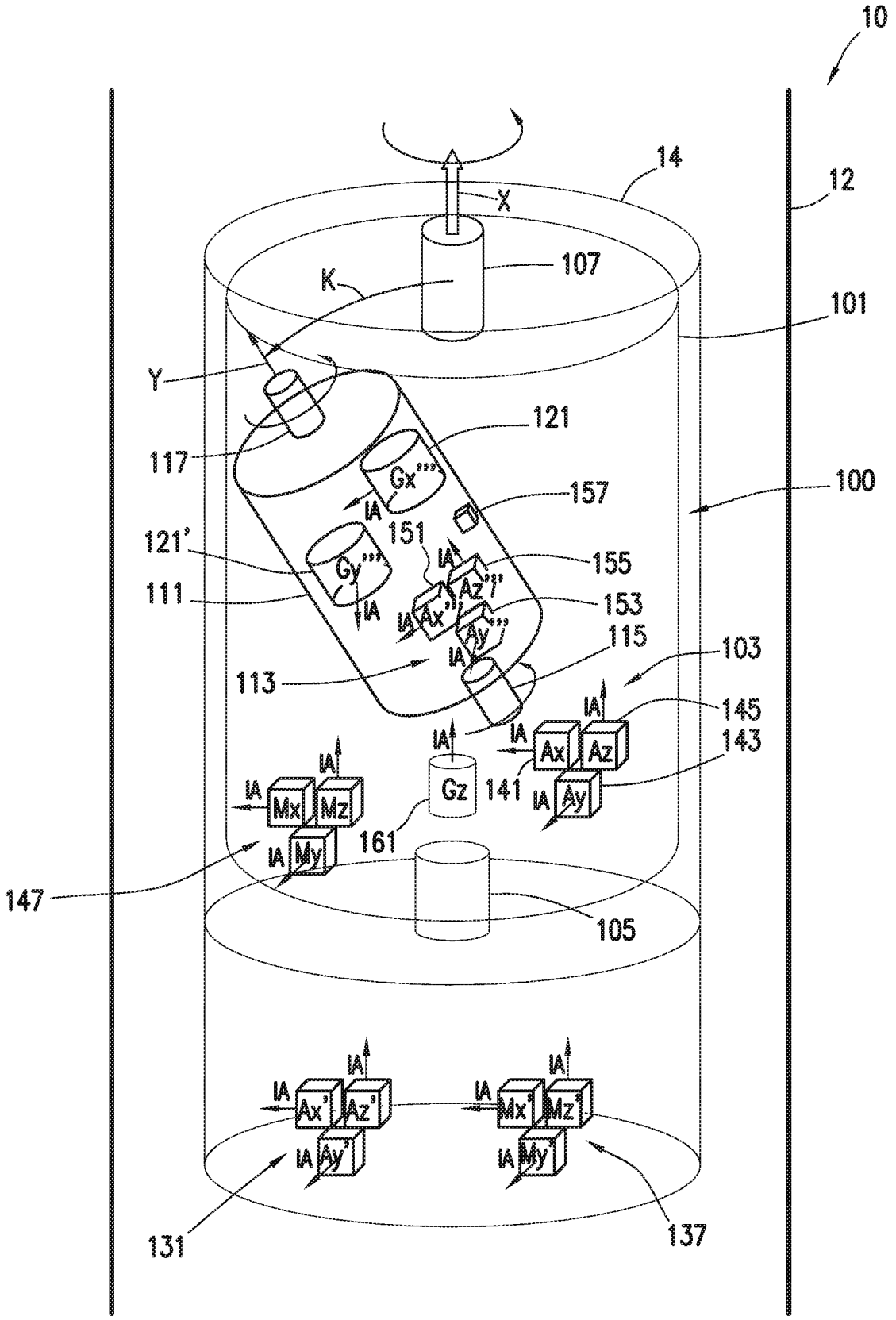
FIG. 2 depicts a schematic view of a sensor platform consistent with at least one embodiment of the present disclosure.

As depicted in FIG. 2, gimbal sensor platform 100 may include outer gimbal 101. Outer gimbal 101 may be rotatably coupled to tool body 12 such that outer gimbal 101 may rotate relative thereto. In some embodiments, outer gimbal axis of rotation X may be substantially aligned with or parallel to longitudinal axis 15 of downhole survey tool 10. In some embodiments, outer gimbal axis of rotation X may be out of alignment with or canted to longitudinal axis 15 of tool body 12 of downhole survey tool 10. In some such embodiments, the angle between outer gimbal axis of rotation X and longitudinal axis 15 may define an outer gimbal cant angle, and the direction of outer gimbal axis of rotation X relative to longitudinal axis 15 may be known. In some embodiments, outer gimbal 101 may include outer gimbal sensor platform 103. As discussed herein below, one or more sensors may be coupled to outer gimbal sensor platform 103.

In some embodiments, outer gimbal 101 may be coupled to tool body 12 by outer angular positioning device 105. Outer angular positioning device 105 may be a torque motor, stepper motor, brushless motor, brushed motor, geared motor, piezoelectric motor, rotary actuator, linear actuator, hydraulic actuator, pneumatic actuator, or combinations thereof. Outer angular positioning device 105 may be positioned between outer gimbal 101 and tool body 12 such that actuation of outer angular positioning device 105 may cause rotation of outer gimbal 101 relative to tool body 12. In some embodiments, outer angular position measuring device 107 may be coupled between outer gimbal 101 and tool body 12. Outer angular position measuring device 107 may measure the relative rotation between outer gimbal 101 and tool body 12. Outer angular positioning device 107 may be any device capable of measuring the relative rotation between outer gimbal 101 and tool body 12, and may include, for example and without limitation, a resolver, optical encoder, capacitive encoder, magnetic encoder, rotary potentiometer, rotary variable differential transformer, synchro, or combinations thereof. In some embodiments, wherein outer angular positioning device 105 is a stepper motor, the relative rotation between outer gimbal 101 and tool body 12 may be determined at least in part by counting the number of steps taken by the stepper motor. In some embodiments, one or more outer limit stops 102 as discussed further herein below may be included to, for example and without limitation, provide an index or reference location for the stepper motor. One having ordinary skill in the art with the benefit of this disclosure will understand that the specific depiction of outer angular positioning device 105 and outer angular position measuring device 107 in the accompanying figures is merely exemplary and is not intended to limit the scope of this disclosure. For example, in some embodiments, outer angular position measuring device 107 may be located within or as a part of outer angular positioning device 105. In other embodiments, one or both of outer angular positioning device 105 and outer angular position measuring device 107 may be positioned away from outer gimbal axis of rotation X, and one or more axles (not shown) may couple outer gimbal 101 to tool body 12. One having ordinary skill in the art with the benefit of this disclosure will understand that additional mechanisms, including, for example and without limitation, bearings, gear boxes, etc. may be used without deviating from the scope of this disclosure.

In some embodiments, gimbal sensor platform 100 may include inner gimbal 111. Inner gimbal 111 may be rotatably coupled to outer gimbal 101 such that inner gimbal 111 may rotate relative thereto. In some embodiments, inner gimbal axis of rotation Y may be offset by cant angle K from outer gimbal axis of rotation X. In some such embodiments, cant angle K may be preselected. In some embodiments, inner gimbal axis of rotation Y may be substantially perpendicular to outer gimbal axis of rotation X, i.e. a case where cant angle K is 90°. In some embodiments, cant angle K may be between 0° and 90°. In some embodiments, cant angle K may be between 5° and 35°. In some embodiments, cant angle K may be between 10° and 20°. In some embodiments, inner gimbal 111 may include inner gimbal sensor platform 113. As discussed herein below, one or more sensors may be coupled to inner gimbal sensor platform 113. In some embodiments, cant angle K may at least partially determine the outer diameter of gimbal sensor platform 100. In some embodiments, cant angle K may be selected such that gimbal sensor platform 100 has a desired outer diameter.

In some embodiments, inner gimbal 111 may be coupled to outer gimbal 101 by inner angular positioning device 115. Inner angular positioning device 115 may be a torque motor, stepper motor, brushless motor, brushed motor, geared motor, piezoelectric motor, rotary actuator, linear actuator, hydraulic actuator, pneumatic actuator, or combinations thereof. Inner angular positioning device 115 may be positioned between inner gimbal 111 and outer gimbal 101 such that actuation of inner angular positioning device 115 may cause rotation of inner gimbal 111 relative to outer gimbal 101. In some embodiments, inner angular position measuring device 117 may be coupled between inner gimbal 111 and outer gimbal 101. Inner angular position measuring device 117 may measure the relative rotation between inner gimbal 111 and outer gimbal 101. Inner angular positioning device 117 may be any device capable of measuring the relative rotation between outer gimbal 101 and inner gimbal 111, and may include, for example and without limitation, a resolver, optical encoder, capacitive encoder, magnetic encoder, rotary potentiometer, rotary variable differential transformer, synchro, or combinations thereof. In some embodiments, wherein inner angular positioning device 115 is a stepper motor, the relative rotation between outer gimbal 101 and inner gimbal 111 may be determined at least in part by counting the number of steps taken by the stepper motor. In some embodiments, one or more inner limit stops 112 as discussed further herein below may be included to, for example and without limitation, provide an index or reference location for the stepper motor. One having ordinary skill in the art with the benefit of this disclosure will understand that the specific depiction of inner angular positioning device 115 and outer angular position measuring device 117 in the accompanying figures is merely exemplary and is not intended to limit the scope of this disclosure. For example, in some embodiments, inner angular position measuring device 117 may be located within or as a part of inner angular positioning device 115. In other embodiments, one or both of inner angular positioning device 115 and inner angular position measuring device 117 may be positioned away from inner gimbal axis of rotation Y, and one or more axles (not shown) may couple inner gimbal 111 to outer gimbal 101. One having ordinary skill in the art with the benefit of this disclosure will understand that additional mechanisms, including, for example and without limitation, bearings, gear boxes, etc. may be used without deviating from the scope of this disclosure.

In operation, by rotating outer gimbal 101, outer gimbal sensor platform 103 may be rotated about outer gimbal axis of rotation X. Likewise, by rotating inner gimbal 111, inner gimbal sensor platform 113 may be rotated about inner gimbal axis of rotation Y. By combining rotation of outer gimbal 101 and inner gimbal 111, sensors coupled to inner gimbal sensor platform 113 may be repositionable in a variety of orientations while not requiring slewing, sliding, or rotation of downhole survey tool 10. Likewise, sensors coupled to outer gimbal sensor platform 103 may be repositionable by rotation of outer gimbal 101 about outer gimbal axis of rotation X while not requiring slewing, sliding, or rotation of downhole survey tool 10. In some embodiments, one or both of outer gimbal 101 and inner gimbal 111 may be rotatable by at least a full rotation or only by a partial rotation.

Figure 3:
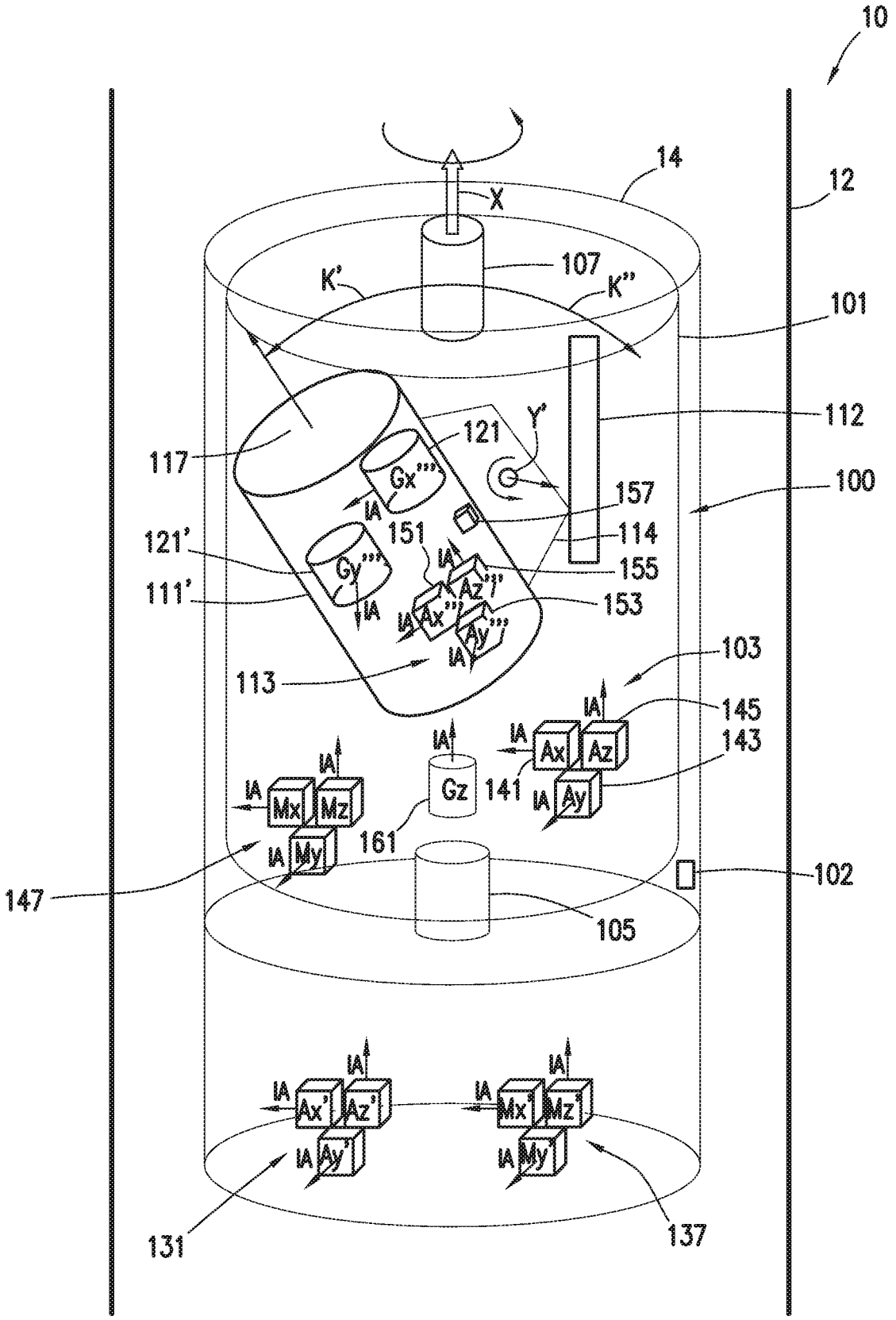
FIG. 3 depicts a schematic view of a sensor platform consistent with at least one embodiment of the present disclosure.

In some embodiments, one or more outer limit stops 102, as depicted in FIG. 3, may be coupled to tool body 12 such that outer gimbal 101 contacts outer limit stops 102 when outer gimbal 101 is positioned at a first rotational position or a second rotational position relative to tool body 12. One having ordinary skill in the art with the benefit of this disclosure will understand that outer limit stops 102 as used herein may be any structure or structures which limit the rotation of outer gimbal 101 with respect to tool body 12, and are not intended to be limited to a stop plate as depicted in FIG. 3.

In some embodiments, for example and without limitation, such as depicted in FIG. 3, inner gimbal 111' may have inner gimbal axis of rotation Y' substantially orthogonal to outer gimbal axis of rotation X. In such an embodiment, the cant angle K' of inner gimbal 111' may be varied by rotation of inner gimbal 111' along inner gimbal axis of rotation Y'. Inner gimbal 111' may, for example, change position to change from cant angle K' to a second cant angle, depicted as second cant angle K". In some embodiments, outer gimbal 101 and inner gimbal 111 may be constrained in movement by one or more limit stops or stop plates. In some embodiments, one or more inner limit stops 112 may be coupled to outer gimbal 101 such that inner gimbal 111' contacts inner limit stops 112 when inner gimbal 111' is positioned at a first cant and a second cant, depicted in FIG. 3 as cant angles K' and K". Although depicted only with respect to inner gimbal 111', one having ordinary skill in the art with the benefit of this disclosure will understand that inner limit stops 112 as used herein may be any structure or structures which limit the rotation of inner gimbal 111' with respect to outer gimbal 101, and are not intended to be limited to a stop plate as depicted in FIG. 3. In such an embodiment, cant angle K' between inner gimbal 111' and outer gimbal 101 is varied by rotation of inner gimbal 111' about inner gimbal axis of rotation Y'. In some such embodiments, inner gimbal 111' may contact an inner limit stop 112 when rotated to a first cant angle K' and when rotated to a second cant angle K". In some embodiments, inner limit stops 112 may be positioned such that cant angle K' and K" may be substantially equal in magnitude in opposite direction relative to outer gimbal axis of rotation X. In some embodiments, cant angle K' may be substantially 45° from outer gimbal axis of rotation X, and cant angle K" may be substantially 45° from outer gimbal axis of rotation X in the opposite direction. In such an embodiment, inner gimbal sensor platform 113 may be rotated substantially 90°. In some embodiments, cant angle K' and K" may be unequal. In some embodiments, cant angles K' and K" may be between 1° and 45°. In some embodiments, cant angles K' and K" may be between 5° and 35°. In some embodiments, cant angles K' and K" may be between 10° and 20°.

In operation, by rotating outer gimbal 101, outer gimbal sensor platform 103 may be rotated about outer gimbal axis of rotation X. Likewise, by rotating inner gimbal 111', inner gimbal sensor platform 113 may be moved from the first cant angle K' to the second cant angle K". By combining rotation of outer gimbal 101 and inner gimbal 111', sensors coupled to inner gimbal sensor platform 113 may be repositionable in a large variety of orientations while not requiring slewing, sliding, or rotation of downhole survey tool 10. Likewise, sensors coupled to outer gimbal sensor platform 103 may be repositionable by rotation of outer gimbal 101 about outer gimbal axis of rotation X while not requiring slewing, sliding, or rotation of downhole survey tool 10. In some embodiments, one or both of outer gimbal 101 and inner gimbal 111' may be rotatable by at least a full rotation or only by a partial rotation.

In a survey operation, with reference to FIG. 2, downhole survey tool 10 may be positioned within wellbore 20 at a position desired to be surveyed, referred to herein as the survey point. Outer gimbal 101 may be rotated between two or more positions. At each position of outer gimbal 101, inner gimbal 111 may likewise be rotated among two or more positions. At each position of outer gimbal 101, one or more sensor readings may be taken from sensors positioned in outer gimbal sensor platform 103 at each position. At each position of inner gimbal 111 when at each position of outer gimbal 101, sensor readings may be taken from sensors positioned in inner gimbal sensor platform 113. By rotating outer gimbal 101 and inner gimbal 111, the sensitive axes of any sensors coupled to outer gimbal sensor platform 103 and inner gimbal sensor platform 113 may be moved while not requiring slewing, sliding, or rotation of downhole survey tool 10.

In some embodiments, the orientation of outer gimbal 101 and inner gimbal 111 may be determined by one or more of gravity, magnetic, or inertial reference, or may be measured relative to downhole sensor tool 10.

In some embodiments, utilizing a gravity reference, one or more accelerometers may be utilized to determine the orientation of outer gimbal 101 and inner gimbal 111 relative to the Earth's gravity field. As depicted in FIG. 2, for example and without limitation, in some embodiments, one or more accelerometers 131 may be coupled to tool body 12. Accelerometers 131 may detect the Earth's gravity field relative to tool body 12. Outer angular position measuring device 107 may be utilized to detect the relative orientation between tool body 12 and outer gimbal 101. Inner angular position measuring device 117 may be utilized to detect the relative orientation between inner gimbal 111 and outer gimbal 101. One having ordinary skill in the art with the benefit of this disclosure will understand that although three accelerometers 131 are depicted in FIG. 2, fewer or additional accelerometers may be utilized without deviating from the scope of this disclosure.

In some embodiments, one or more accelerometers may be coupled to outer gimbal sensor platform 103. For example, in some embodiments, a single accelerometer 141 may be coupled to outer gimbal sensor platform 103. In some embodiments, accelerometer 141 may be positioned such that its sensitive axis is at an angle or canted relative to outer gimbal axis of rotation X. In some embodiments, accelerometer 141 may be positioned such that its sensitive axis is substantially orthogonal to outer gimbal axis of rotation X. Sensor readings from accelerometer 141 may be taken at various orientations of outer gimbal 101 to determine the orientation of outer gimbal 101 relative to the Earth's gravity field. In some embodiments, comparing the sensor readings may allow any bias error of the accelerometer to be determined.

In some embodiments, a second accelerometer 143 may be coupled to outer gimbal sensor platform 103. In some embodiments, second accelerometer 143 may be positioned such that its sensitive axis is substantially orthogonal to that of accelerometer 141. In embodiments in which the sensitive axis of accelerometer 141 is oriented substantially orthogonally to outer gimbal axis of rotation X, second accelerometer 143 may be positioned such that its sensitive axis is mutually orthogonal to that of accelerometer 141 and outer gimbal axis of rotation X. In some embodiments, second accelerometer 143 may be positioned such that its sensitive axis is substantially parallel to outer gimbal axis of rotation X.

In some embodiments, a third accelerometer 145 may be coupled to outer gimbal sensor platform 103. In some embodiments, accelerometers 141, 143, and 145 may be oriented such that their sensitive axes are mutually orthogonal. In some embodiments, accelerometers 141, 143, and 145 are oriented such that no sensitive axis of an accelerometer is aligned with outer gimbal axis of rotation X. Rotation of outer gimbal 101 may, for example and without limitation, allow for bias error in accelerometers 141, 143, 145 to be detected or for failure to be detected. In some embodiments, more than three accelerometers may be coupled to outer gimbal sensor platform 103 without deviating from the scope of this disclosure.

In some embodiments wherein no accelerometers are coupled to inner gimbal sensor platform 113, the relative orientation between inner gimbal 111 and outer gimbal 101 may be determined by inner angular position measuring device 117. In some embodiments, such as that depicted in FIG. 3, wherein inner limit stops 112 are utilized, the relative orientation between inner gimbal 111' and outer gimbal 101 may be determined from the known cant angles K' and K" as discussed herein above.

In some embodiments, one or more accelerometers may be coupled to inner gimbal sensor platform 113. For example, in some embodiments, a single accelerometer 151 may be coupled to inner gimbal sensor platform 113. In some embodiments, accelerometer 151 may be positioned such that its sensitive axis is at an angle or canted relative to inner gimbal axis of rotation Y. In some embodiments, accelerometer 151 may be positioned such that its sensitive axis is substantially orthogonal to inner gimbal axis of rotation Y. Sensor readings from accelerometer 151 may be taken at various orientations of outer gimbal 101 to determine the orientation of outer gimbal 101 relative to the Earth's gravity field. In some embodiments, comparing the sensor readings may allow any bias error of the accelerometer to be determined.

In some embodiments, a second accelerometer 153 may be coupled to inner gimbal sensor platform 113. In some embodiments, second accelerometer 153 may be positioned such that its sensitive axis is substantially orthogonal to that of accelerometer 151. In embodiments in which the sensitive axis of accelerometer 151 is oriented substantially orthogonally to inner gimbal axis of rotation Y, second accelerometer 153 may be positioned such that its sensitive axis is mutually orthogonal to that of accelerometer 151 and inner gimbal axis of rotation Y. In some embodiments, second accelerometer 153 may be positioned such that its sensitive axis is substantially parallel to inner gimbal axis of rotation Y.

In some embodiments, a third accelerometer 155 may be coupled to inner gimbal sensor platform 113. In some embodiments, accelerometers 151, 153, and 155 may be oriented such that their sensitive axes are mutually orthogonal. In some embodiments, accelerometers 151, 153, and 155 are oriented such that no sensitive axis of an accelerometer is aligned with inner gimbal axis of rotation Y. Rotation of outer gimbal 101 or inner gimbal 111 may, for example and without limitation, allow for bias error in accelerometers 151, 153, 155 to be detected or for failure to be detected. In some embodiments, more than three accelerometers may be coupled to inner gimbal sensor platform 113 without deviating from the scope of this disclosure.

In some embodiments, in which no accelerometers are coupled to outer gimbal sensor platform 103, the relative orientation between inner gimbal 111 and outer gimbal 101 may be determined utilizing inner angular position measuring device 117. In some embodiments, in which accelerometers are positioned in two or more of inner gimbal sensor platform 113, outer gimbal sensor platform 103, and tool body 12, readings of each accelerometer and inner angular position measuring device 117 and outer angular position measuring device 107 may be utilized to, for example and without limitation, detect bias error or detect failure on any of the accelerometers.

In some embodiments, utilizing a magnetic reference, one or more magnetometers may be utilized to determine the orientation of outer gimbal 101 and inner gimbal 111 relative to the local magnetic field. Magnetometers may be coupled to tool body 12 (magnetometers 137), coupled to outer gimbal sensor platform 103 (magnetometers 147), or coupled to inner gimbal sensor platform 113 (magnetometers 157). Magnetometers may be positioned and utilized in much the same way as accelerometers as discussed herein above.

In some embodiments, positioning gyro 161 may be coupled to outer gimbal sensor platform 103. Positioning gyro 161 may, for example and without limitation, be utilized to detect rotation of outer gimbal 101 relative to an inertial reference frame. Although not depicted, one or more positioning gyros may be positioned in inner gimbal 111 or tool body 12.

One having ordinary skill in the art with the benefit of this disclosure will understand that a combination of angular position measuring devices, accelerometers, positioning gyro, and magnetometers may be utilized to determine the orientations of outer gimbal 101 and inner gimbal 111.

In some embodiments, gyro 121 may be coupled to inner gimbal sensor platform 113. Gyro 121 may, in some embodiments, be a single degree of freedom gyro whose sensitive axis is substantially perpendicular to inner gimbal axis of rotation Y. By rotating outer gimbal 101 and inner gimbal 111, the sensitive axis of gyro 121 may be rotated through a series of orientations with respect to downhole survey tool 10. By taking multiple readings at various orientations of gyro 121, measurements of the Earth spin vector may be obtained where a fixed, single axis gyro may be incapable of accurate measurement, such as at high inclinations.

In some embodiments, outer gimbal 101 may be rotated to two or more positions. At each position, the orientation of outer gimbal 101 may be determined as discussed herein above. In some embodiments, outer gimbal 101 may be rotated to three positions. In some such embodiments, the three positions may be substantially 120° apart. In some such embodiments, inner gimbal 111 may be stationary relative to outer gimbal 101 while outer gimbal 101 is rotated.

In some embodiments, at each position of outer gimbal 101, inner gimbal 111 may be rotated to two or more positions. In some embodiments, inner gimbal 111 may be rotated to two positions which are substantially 180° apart. In other embodiments, inner gimbal 111 may be rotated to two positions which are less than 180° apart, such as in an embodiment as discussed herein above with respect to FIG. 3.

In some embodiments, gyro 121 may take a measurement at each position of inner gimbal 111 and outer gimbal 101. In some embodiments, gyro 121 may be positioned such that its sensitive axis is aligned in three orthogonal axes, allowing the three spatial components of the Earth spin vector to be measured using a single axis gyro 121. In some embodiments, gyro 121 may be positioned and measurements taken to identify, detect, or estimate any gyro sensor bias or gyro mass unbalance.

Additionally, in some embodiments, by rotating inner gimbal 111 and outer gimbal 113, the readings from gyro 121 may be used to detect or estimate azimuth, gyro toolface, any gyro sensor bias, gyro mass unbalance, or other gyro sensor errors. In some embodiments, readings from gyro 121 may be combined with other sensor readings, including readings from one or more of accelerometers 141, 143, 145, 151, 153, and 155; magnetometers 147; outer angular position measuring device 107; inner angular position measuring device 117; or a combination thereof to detect or estimate azimuth, gyro toolface, any gyro sensor bias, gyro mass unbalance, or other gyro sensor errors. The detected or estimated gyro sensor bias and gyro mass unbalance may be used, for example and without limitation, to improve the accuracy of the determined gyro toolface and azimuth of downhole survey tool 10 based on the measurements of gyro 121. In some embodiments, the rotation of outer gimbal 101 and inner gimbal 111 may be selected such that a first measurement from gyro 121 is taken with gyro 121 oriented in a first direction and a second measurement is taken from gyro 121 with gyro 121 oriented in a direction opposite that of the first measurement. In some embodiments, multiple measurements of gyro 121 may be taken such that a first, second, and third measurement of gyro 121 are taken each at different orientations by rotating one or both of inner gimbal 111 and outer gimbal 101. In some embodiments, three or more gyro readings at different orientations of gyro 121 may be utilized. In some embodiments, three gyro readings may be taken such that the sensitive axis of gyro 121 is oriented along one of three mutually orthogonal axes during each measurement. In some embodiments, six or more gyro readings may be utilized. In some embodiments, six gyro readings may be taken such that three gyro readings may be taken such that the sensitive axis of gyro 121 is oriented one of three mutually orthogonal axes during each measurement, and the other three are taken along the three mutually orthogonal axes in directions opposite the first three measurements.

In some embodiments, wherein inner gimbal 111 is canted to outer gimbal 101, three or more measurements may be taken by gyro 121 by rotation of outer gimbal 101. In some such embodiments, where gyro 121 is not affected by mass unbalance or other sensor errors, azimuth may be determined without rotation of inner gimbal 111. In some embodiments in which gyro 121 is affected by mass unbalance, a recent estimate of mass unbalance or other sensor errors may be utilized or inner gimbal 111 may be actuated as described herein to determine azimuth, gyro toolface, mass unbalance or other sensor errors.

One having ordinary skill in the art with the benefit of this disclosure will understand that inner gyro sensor platform 113 is not restricted to having only a single gyro sensor coupled thereto. For example and without limitation, a second gyro, 121' coupled thereto. In such an embodiment, fewer readings from gyro 121 and 121' may be used to generate redundant measurements to, for example and without limitation, improve accuracy or detect bias errors or mass unbalance. In some embodiments, utilizing multiple gyros 121, 121', a desired number of measurements may be made with fewer reorientations of outer gimbal 101 and inner gimbal 111 than embodiments utilizing a single gyro 121. In some embodiments, gyros 121, 121', each measuring a single bias free cross-axis component of the Earth's spin vector as well as a bias free long axis component of the Earth's spin vector, may be utilized. In such an embodiment, the measurements may be made at 4 positions: a first position of outer gimbal 101 and inner gimbal 111 at a first and second position, and a second position of outer gimbal 101 offset from the first position by substantially 180° with inner gimbal 111 in the first and second positions. In some embodiments, gyro 121 or multiple gyros 121, 121', may have multiple sensitive input axes.

Furthermore, by rotating outer gimbal 101 and inner gimbal 111, measurements of any other sensors coupled thereto, such as, for example and without limitation, accelerometers 141, 143, 145, 151, 153, and 155 or magnetometers 147, may be taken, and may be used to determine any bias error of these sensors. In some embodiments, two or more measurements from the sensors may be taken with the sensors positioned in different orientations by movement of inner gimbal 111, outer gimbal 101, or both. In some embodiments, a first measurement may be compared to a second measurement of a sensor taken after a movement of one or both of inner gimbal 111 and outer gimbal 101. Because the measured field is generally static, comparison of the first and second measurements (or any additional measurements taken) may allow bias or other error to be identified. In some embodiments, measurements from the sensors may be utilized to calculate azimuth, inclination, magnetic toolface, gravity toolface, or gyro toolface. Sensors mounted to inner gimbal 111, outer gimbal 101, and tool body 12 may be utilized to determine relative orientation of inner gimbal 111 and outer gimbal 101 relative to each other and relative to tool body 12. The determination of the orientation of gyro 121 may be determined at least in part based on measurements of accelerometers 141, 143, 145, 151, 153, and 155; magnetometers 147; outer angular position measuring device 107; inner angular position measuring device 117; or a combination thereof.

In some embodiments, as understood by one having ordinary skill in the art with the benefit of this disclosure, more than two gyros or multi-axis gyros may be used without deviating from the scope of this disclosure. In some embodiments, additional gyros may be used to, for example, add redundant readings or account for sensor failure.

In some embodiments, rotation of outer gimbal 101 and inner gimbal 111 may be continuous or discontinuous. Rotation of outer gimbal 101 and inner gimbal 111 need not be in a single direction.

In some embodiments, azimuth, computed Earth's rate, bias, mass unbalance, and other sensor parameters which may include values produced by a set of equations may be identified, determined or estimated. In some embodiments, a closed calculation may be utilized. In such an embodiment, measurements from any gyros may be re-expressed in terms of cross axis components (main and quadrature), as well as a pair of bias components. The common mode of the bias components is the true sensor bias, while the difference is the signal. The cross-axis components may be rotated into in-phase and out of phase gyro signals: the out of phase signal may be proportional to the sine of azimuth, and the difference bias may be combined with the out of phase signal to generate a value proportional to the cosine of azimuth.

As an example, in an embodiment in which inner gimbal axis of rotation Y' is substantially perpendicular to outer gimbal axis of rotation X, such as the embodiment depicted in FIG. 3, determination of the azimuth of downhole survey tool 10 may involve a conversion of the measurements of a gyro into in-phase, out of phase, and bias components for each of the cant angles K', K". As used herein, $ER_H$ is defined as the horizontal component of Earth's rotation rate; $ER_V$ is defined as the vertical component of Earth's rotation rate; I is the inclination of tool body 12; $A_Z$ is the azimuth of tool body 12; $MU_{IX}$ is defined as equivalent to a mass shift along the input axis; $MU_{SX}$ is defined as equivalent to a mass shift along the spin axis of gyro; $Tu_{Oi}$ is defined as the cant angle K of inner gimbal 111 or 111' wherein subscript i corresponds to the cant angle K for each successive position of inner gimbal 111 or 111'; $TF_{On}$ and $TF_{Oi}$ are defined as the offset of outer gimbal 101 from tool body 12 as read from outer angular position measuring device 107; $AC_n$ is the output of a cross-axis accelerometer mounted to outer gimbal 101; $AL_n$ is the output of an accelerometer whose sensitive axis is aligned with the longitudinal axis 15 of tool body 12; $A_{X'}$, $A_{Y'}$, and $A_{Z'}$ are mutually orthogonal components of gravity referenced to tool body 12 such that $A_{Z'}$ is the component of gravity in-line with the longitudinal axis 15 of tool body 12; N is the number of angular positions to which outer gimbal 101 is rotated; subscript n or i corresponds to the reading for each successive angular position of outer gimbal 101 with respect to the tool body; $Tf_H$ is defined as the gravity toolface of tool body 12 also known as a high-side toolface, or the rotation angle about the longitudinal axis 15 of tool body 12 with respect to the gravity vector; IP is defined as the portion of the gyro output that is in-phase with gravity, that is, the vertical component of the gyro output; and OP is defined as the portion of the gyro output that is out of phase with gravity, that is, the horizontal component of the gyro output. One having ordinary skill in the art with the benefit of this disclosure will understand that for aligned sensors, $A_{X'}$ may be given by:

$$A_{X'} = \frac{2}{N}\sum_{n=1}^{N} AC_n \cos TF_{On}$$

$A_{Y'}$ may be given by:

$$A_{Y'} = \frac{2}{N}\sum_{n=1}^{N} AC_n \sin TF_{On}$$

$A_{Z'}$ may be given by:

$$A_{Z'} = \frac{1}{N}\sum_{n=1}^{N} AL_n$$

From which I may be determined by:

$$I = \tan^{-1}\left(\frac{\sqrt{A_{X'}^2 + A_{Y'}^2}}{-A_{Z'}}\right)$$

And $Tf_H$ may be determined by:

$$Tf_H = \tan^{-1}\left(\frac{-A_{Y'}}{A_{X'}}\right)$$

IP may be given by:

$$(ER_H \cos(Az)\cos(I)+(MU_{SX}+ER_V)*\sin(I))*\cos(Tu_{Oi})$$

And OP may be given by $$-(ER_H \sin(Az)+MU_{IX}*\sin(I))*\cos(Tu_{Oi})$$

As used in the following equations, bias includes the along-hole portion of the Earth's rate as well as gyro bias. For a fixed inner gimbal cant angle, $Tu_O$, the along-hole component of Earth's rate does not change and therefore looks like a bias as the position of outer gimbal 101 is changed. One having ordinary skill in the art with the benefit of this disclosure will understand that for aligned sensors, bias may be given by $-(ER_H \cos(Az)\sin(I)-(MU_{SX}+ER_V)*\cos(I))\sin(Tu_{Oi})$. As used in the following equations, Gbias is defined as gyro bias, or the portion of the gyro output that does not change with gyroscope orientation change.

Given a series of gyro measurements $GO_n$ at a fixed cant angle $Tu_o$ and a series of toolface offset angles, i.e. positions of outer gimbal 101, the following system of equations may be solved to determine the in-phase (IP), out of phase (OP), and bias components:

$$\begin{aligned} GO_0 &= IP\cos(Tf_{o_0}) + OP\sin(Tf_{o_0}) + \text{bias} \\ GO_1 &= IP\cos(Tf_{o_1}) + OP\sin(Tf_{o_1}) + \text{bias} \\ &\vdots \\ GO_n &= IP\cos(Tf_{o_n}) + OP\sin(Tf_{o_n}) + \text{bias} \end{aligned}$$

Assuming an existing determination of inclination (I) and highside toolface ($Tf_H$), both pairs of in-phase and out-of-phase components may be converted into one component in-phase and another out of phase with gravity. Dividing both phases by the cosine of the fixed cant angle $Tu_O$, the in-phase component may be given by:

$$ER_H \cos(Az)\cos(I)+(ER_V+MU_{SX})\sin(I)$$

and the out of phase component may be proportional to:

$$-ER_H \sin(Az)+MU_{SX})\sin(I)$$

Although these equations assume no misalignment angles, one having ordinary skill in the art with the benefit of this disclosure will understand that these effects may be identified and compensated for.

With the pair of bias terms, dividing the difference by the sine of cant angle $Tu_O$ may be proportional to:

$$ER_H \cos(Az)\sin(I)-(ER_V+MU_{SX})\cos(I)$$

Multiplying this equation by the sine of inclination and the in-phase with gravity by the cosine of inclination and adding the two, the result is:

$$ER_H \cos(Az)$$

Multiplying the in-phase by sine of inclination and subtracting the scaled bias difference, $MU_{SX}$ may be calculated from:

$$(ER_V+MU_{SX})$$

The sine of azimuth term may be generated or predicted by subtracting off the influence of the input axis mass unbalance $MU_{IX}$. The input axis mass unbalance may be better behaved than that of the spin axis, and may be corrected such that the RMS value of these components is equal to $ER_H$.

In some embodiments, a forward model is used to determine azimuth, computed Earth's rate, bias, and mass unbalance, and may utilize a model for the measurement of gyro 121 at each position as discussed herein above. In some such embodiments, pseudo-measurements may be included in each model. Pseudo-measurements may, for example and without limitation, constrain parameters or groups of parameters. The final set of parameters may be determined or estimated from minimizing a measure of error between the modeled and measured values.

As an example of a forward model solution, a model of the expected gyro outputs $GO_i$ for a given inclination I and highside toolface $Tf_H$, and azimuth Az may be generated or predicted. For the purposes of this disclosure, the subscript "i" denotes the various known values of toolface offset $Tf_{Oi}$ and cant angle $Tu_{Oi}$. In some embodiments, the model output may be:

$$GO_i = \begin{bmatrix} (ER_H\cos(Az)\cos(I) + (MU_{SX} + ER_V)*\sin(I))\cos(Tf_H + Tf_{o_i}) - \\ (ER_H\sin(Az) + MU_{IX}*\sin(I))\sin(Tf_H + Tf_{o_i}) \end{bmatrix} \cos(Tu_{O_i}) - (ER_H\cos(Az)\sin(I) - (MU_{SX} + ER_V)*\cos(I))\sin(Tu_{O_i}) + Gbias$$

Gyro bias (Gbias), $MU_{SX}$ and $MU_{IX}$ may be included as part of an azimuth cost function, although calibrated values may be utilized instead. Solving the cost function may include minimizing for some measure of the differences between the measured and modelled gyro outputs at the various toolface and cant angles. In some embodiments, a numerical optimizer, M-estimators, and/or adaptive filters may be utilized. In some embodiments, differences between the modeled and measured outputs may be the sum of the square of the differences, the sum of the absolute value of the differences, or another model. In some embodiments, pre-established values of $MU_{SX}$ and $MU_{IX}$ may be used as starting values in the optimization. In some embodiments, values of the estimated parameters from along-hole measurements and cross-axis measurements may be fused using for example but not limited to a complimentary filter.

In some embodiments inner gimbal 111 may be fixed relative to outer gimbal 101. In some such embodiments, downhole survey tool 10 may be operated in attitude reference mode as understood in the art.

One having ordinary skill in the art with the benefit of this disclosure will understand that the positions at which measurements are made from gyro 121 sensors do not have to be in antiparallel directions to effect an estimation of the current gyro bias, where bias is reasonably stable and that the orientation of the tool body 12 is substantially stable. In other words, while a single pair of antiparallel readings could be performed to make a simple determination of the basic sensor bias, this sequencing is not necessary for that determination.

Electrical connections between a power source (not shown) and sensors on outer gimbal sensor platform 103 and inner gimbal sensor platform 113 may be made using any system known in the art, including, for example and without limitation, flexible cables and slip rings.

In some embodiments, gyro 121 may be floated. As understood by one having ordinary skill in the art with the benefit of this disclosure, floating the gyro may, for example and without limitation, reduce the susceptibility of gyro 121 to damage from shock and vibration.

In some embodiments, in addition to azimuth, sensor platform 100 may be utilized to determine gyro toolface, status of gyro 121, or azimuth determination uncertainty.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A gimbal sensor platform positionable in a tool body having a longitudinal axis, the gimbal sensor platform comprising:

an outer gimbal, the outer gimbal rotatably coupled to the tool body;

an outer angular positioning device coupled to the outer gimbal to rotate the outer gimbal relative to the tool body about an outer gimbal axis of rotation;

an inner gimbal, the inner gimbal rotatably coupled to the outer gimbal;

an inner angular positioning device coupled to the inner gimbal to rotate the inner gimbal relative to the outer gimbal about an inner gimbal axis of rotation; and a gyro coupled to the inner gimbal.

2. The gimbal sensor platform of claim 1, wherein the outer gimbal axis of rotation is substantially parallel to the longitudinal axis of the tool body.

3. The gimbal sensor platform of claim 1, wherein the inner gimbal axis of rotation is canted to the outer gimbal axis of rotation.

4. The gimbal sensor platform of claim 3, wherein the inner gimbal axis of rotation is substantially perpendicular to the outer gimbal axis of rotation.

5. The gimbal sensor platform of claim 4, further comprising an inner limit stop, the inner limit stop positioned to restrict rotation of the inner gimbal between a first cant angle and a second cant angle relative to the outer gimbal axis of rotation.

6. The gimbal sensor platform of claim 5, wherein the first cant angle and second cant angle are in opposite directions of the outer gimbal axis of rotation.

7. The gimbal sensor platform of claim 1, further comprising one or more accelerometers coupled to the inner gimbal.

8. The gimbal sensor platform of claim 1, further comprising one or more magnetometers coupled to the inner gimbal.

9. The gimbal sensor platform of claim 1, further comprising one or more accelerometers coupled to the tool body.

10. The gimbal sensor platform of claim 1, further comprising one or more magnetometers coupled to the tool body.

11. The gimbal sensor platform of claim 1, further comprising an outer angular position measuring device coupled between the outer gimbal and the tool body.

12. The gimbal sensor platform of claim 1, further comprising an inner angular position measuring device coupled between the inner gimbal and the outer gimbal.

13. The gimbal sensor platform of claim 1, wherein the gimbal sensor platform is coupled to a drill string or a wireline system.

14. The gimbal sensor platform of claim 1, further comprising an outer limit stop, the outer limit stop positioned to restrict rotation of the outer gimbal relative to the tool body.

15. A method comprising:

providing a gimbal sensor platform positioned in a tool body, the gimbal sensor platform including:

an outer gimbal, the outer gimbal rotatably coupled to the tool body;

an outer angular positioning device coupled to the outer gimbal to rotate the outer gimbal relative to the tool body about an outer gimbal axis of rotation;

an inner gimbal, the inner gimbal rotatably coupled to the outer gimbal;

an inner angular positioning device coupled to the inner gimbal to rotate the inner gimbal relative to the outer gimbal about an inner gimbal axis of rotation; and a gyro coupled to the inner gimbal;

taking a first measurement with the gyro with the outer gimbal in a first position relative to the tool body and the inner gimbal in a first position relative to the outer gimbal;

rotating the inner gimbal to a second position relative to the outer gimbal;

taking a second measurement with the gyro;

rotating the outer gimbal to a second position relative to the tool body, the position of inner gimbal defining a third position; and taking a third measurement with the gyro.

16. The method of claim 15, further comprising determining an azimuth or a gyro toolface of the tool body.

17. The method of claim 15, further comprising determining the orientation of the gyro at each of the first, second, and third measurements relative to the tool body.

18. The method of claim 16, further comprising:

identifying gyro mass unbalance or error based at least in part on the first, second, and third measurements.

19. The method of claim 16, wherein the gimbal sensor platform further comprises one or more accelerometers coupled to one or more of the inner gimbal, outer gimbal, or tool body, and the azimuth of the tool body is determined at least partially based on the readings of the accelerometers.

20. The method of claim 16, wherein the gimbal sensor platform further comprises one or more magnetometers coupled to one or more of the inner gimbal, outer gimbal, or tool body, and the azimuth of the tool body is determined at least partially based on the readings of the magnetometers.

21. The method of claim 16, wherein the gimbal sensor platform further comprises one or both of an inner angular position measuring device coupled between the inner gimbal and the outer gimbal or an outer angular position measuring device coupled between the outer gimbal and the tool body, and the azimuth of the tool body is determined at least partially based on the readings of any angular position measuring device.

22. The method of claim 15, wherein the gimbal sensor platform further comprises one or more accelerometers coupled to one or both of the inner gimbal or outer gimbal, and the method further comprises:

taking a first acceleration measurement with an accelerometer at the first, second, or third position; and determining an azimuth or inclination of the tool body.

23. The method of claim 22, further comprising:

taking a second acceleration measurement with the accelerometer at a different position of the first, second, or third positions; and identifying accelerometer error or bias based on the first and second acceleration measurements.

24. The method of claim 15, wherein the gimbal sensor platform further comprises one or more magnetometers coupled to one or both of the inner gimbal or outer gimbal, and the method further comprises:

taking a first magnetometer measurement with a magnetometer at the first position, second position, or third position; and determining an azimuth or inclination of the tool body.

25. The method of claim 24, further comprising:

taking a second magnetometer measurement with the magnetometer at a different position of the first position, second position, or third position; and identifying magnetometer error or bias based on the first and second magnetometer measurements.

26. A method comprising:

providing a gimbal sensor platform positioned in a tool body, the gimbal sensor platform including:

an outer gimbal, the outer gimbal rotatably coupled to the tool body;

an outer angular positioning device coupled to the outer gimbal to rotate the outer gimbal relative to the tool body about an outer gimbal axis of rotation;

an inner gimbal, the inner gimbal rotatably coupled to the outer gimbal;

an inner angular positioning device coupled to the inner gimbal to rotate the inner gimbal relative to the outer gimbal about an inner gimbal axis of rotation, the inner gimbal axis of rotation substantially orthogonal to the outer gimbal axis of rotation;

an inner limit stop, the inner limit stop positioned to constrain the rotation of the inner gimbal, such that the inner gimbal contacts the limit stop when rotated to a first cant angle relative to the outer gimbal axis of rotation and when rotated to a second cant angle relative to the outer gimbal axis of rotation; and a gyro coupled to the inner gimbal;

taking a first measurement with the gyro with the outer gimbal in a first position relative to the tool body and the inner gimbal at the first cant angle;

rotating the inner gimbal to the second cant angle;

taking a second measurement with the gyro;

rotating the outer gimbal to a second position relative to the tool body; and taking a third measurement with the gyro.

27. The gimbal sensor platform of claim 3, wherein the inner gimbal axis of rotation is canted to the outer gimbal axis of rotation by an angle between 0° and 90°.

28. The gimbal sensor platform of claim 5, wherein the first cant angle and second cant angle are less than 180° apart.

* * * * *